United States Patent [19]

Maple et al.

[11] Patent Number: 4,666,689

[45] Date of Patent: May 19, 1987

[54] PROCESS FOR REGENERATING AN ALKALINE STREAM CONTAINING MERCAPTAN COMPOUNDS

[75] Inventors: Ralph E. Maple; George L. Redd; Donald W. Meurer, all of Houston, Tex.

[73] Assignee: Merichem Company, Houston, Tex.

[21] Appl. No.: 818,078

[22] Filed: Jan. 13, 1986

Related U.S. Application Data

[63] Continuation-in-part of Ser. No. 604,211, Apr. 26, 1984, abandoned.

[51] Int. Cl.[4] ..... C01D 1/04

[52] U.S. Cl. ..... 423/183; 208/235

[58] Field of Search ..... 423/183, 641, 642; 208/206, 235

[56] References Cited

U.S. PATENT DOCUMENTS

| | | | |
|---|---|---|---|
| 2,425,414 | 8/1947 | Bond | 208/235 |
| 2,606,099 | 8/1952 | Happel et al. | 208/235 |
| 2,740,749 | 4/1956 | Meguerian et al. | 208/235 |
| 2,853,432 | 9/1958 | Gleim et al. | 423/183 |
| 2,921,021 | 1/1960 | Urban et al. | 208/206 |
| 2,937,986 | 5/1960 | Lukk | 208/235 |
| 3,107,213 | 10/1963 | Cole et al. | 208/235 |
| 3,574,093 | 4/1971 | Strong | 208/206 |
| 3,758,404 | 9/1973 | Clonts | 422/256 |
| 3,977,829 | 8/1976 | Clonts | 422/256 |
| 3,992,156 | 11/1976 | Clonts | 422/256 |
| 4,090,954 | 5/1978 | Ward | 423/183 |
| 4,362,614 | 12/1982 | Asdigian | 208/235 |
| 4,562,300 | 12/1985 | Lafoy | 208/235 |

*Primary Examiner*—John Doll
*Assistant Examiner*—Wayne A. Langel
*Attorney, Agent, or Firm*—John R. Kirk, Jr.

[57] ABSTRACT

An alkaline solution containing mercaptides is regenerated in an improved process wherein the alkaline solution to be regenerated containing a suitable oxidation catalyst is contacted with an oxygen-containing solvent which is immiscible with said alkaline solution in a reaction zone comprising a plurality of fibers positioned longitudinally within a conduit, whereby the two liquids are in contact while concurrently flowing through said reaction zone during which the mercaptides contained in the alkaline solution are oxidized to disulfides and are simultaneously extracted from the alkaline solution into the solvent solution.

15 Claims, 1 Drawing Figure

PROCESS FOR REGENERATING AN ALKALINE STREAM CONTAINING MERCAPTAN COMPOUNDS

This application is a continuation-in-part of application Ser. No. 604,211, filed 4-26-84, abandoned.

BACKGROUND OF THE INVENTION

A number of hydrocarbon streams produced by refining operations or natural gas processing operations contain mercaptan sulfur compounds and are commonly treated to remove such mercaptan sulfur compounds in order to reduce odor and/or corrosivity associated with these acidic species. For example, alkyl and aryl mercaptans are generally removed from such hydrocarbon streams by washing or contacting such streams with an aqueous solution of an alkali metal hydroxide such as sodium hydroxide or potassium hydroxide. The sulfur compounds are removed into the alkaline stream as mercaptides, i.e. the metal salts of the mercaptans. The alkaline solution containing the mercaptides is then separated from the hydrocarbon stream. In order for the overall treating scheme described to be economically feasible, it is generally necessary to regenerate the alkaline solution and to recycle it for reuse in contacting more of the mercaptan-containing hydrocarbon streams. By "regenerate" is meant the removal of most, if not all, of the mercaptides in the alkaline stream, which may be accomplished by oxidizing the mercaptides to disulfides. The disulfides, which are relatively insoluble in the alkaline solution, may then be removed therefrom as an organic layer. In order to carry out the oxidation, a catalyst is generally employed. Any space suitable catalyst known to those skilled in the art may be utilized, including, for example, any of the catalysts disclosed in U.S. Pat. No. 3,574,093, such as cobalt phthalocyanine or a derivative thereof, such as cobalt phthalocyanine disulfonate.

A typical process for conventionally regenerating the alkaline stream involves the use of an oxidation zone, which typically involves a column having suitable contacting means such as trays with bubble caps, or suitable packing material such as Raschig rings and the like. The alkaline stream in the column is contacted with air in the presence of the oxidation catalyst which is generally contained in the alkaline stream to be regenerated, in order to oxidize the mercaptides to disulfides. Generally, such oxidation zones are relatively large columns which are very expensive to construct and maintain. After a spent alkaline mercaptide containing stream has been processed through an oxidation zone, there is obtained a mixture of regenerated alkaline solution and disulfides, which mixture is typically in the form of a fine dispersion. This mixture must be introduced into a settling zone wherein the mixture is allowed to reside for a considerable time in order to enable the dispersion to coalesce and separate into layers. Due to the fineness of the dispersion, the settler must be relatively large and occasionally additional coalescing aids, mechanical and/or chemical, may be required to insure separation of the disulfide and alkaline phases. There are also systems where the regenerated caustic disulfide mixture is contacted with a solvent solution as is employed with other hydrocarbon treating systems in order to effectively deal with this separation problem.

Another conventional regeneration process consists of air/steam stripping the mercaptides from the alkaline stream, a process which also requires substantial equipment and additionally is energy intensive.

As previously discussed, a settling tank is required in conventional practice to process the dispersed disulfide-caustic mixture by allowing the two phases to coalesce and to separate. The problems of separating constituents of a dispersed or emulsified mixture of this nature necessitate equipment substantial in cost and size. The overall removal of sulfur compounds from alkaline streams thus is limited by several factors, including the capacity of the equipment which is reflected in the efficiency of the oxidation of mercaptides to disulfides and the cleaness or sharpness of the separation of the resulting disulfide or disulfide/solvent mixture from the caustic. Then, of course, there is the increased size of equipment used in these processes with their attendant higher installed cost and higher operating costs, which are additional disadvantages.

It is conventional practice to treat various hydrocarbon streams containing mercaptan sulfur compounds by contacting such a stream with an alkaline solution such as aqueous sodium hydroxide (caustic) whereby the mercaptans are absorbed into the caustic and reacted with it to form mercaptides and thus are separated from the hydrocarbon stream. It is also conventional practice to thereafter regenerate the mercaptide containing caustic solutions to remove the mercaptides and thus render the caustic solution suitable for reuse. The various methods used to regenerate the caustic typically do so by oxidizing the mercaptides to disulfides, generally in the presence of an oxidation catalyst such as certain metal chelates, including, for example, cobalt phthalocyanine disulfonate. Such processes produce a mixture of regenerated caustic and disulfides which must be separated before the regenerated caustic can be reused. Typically, the oxidation of mercaptides to disulfides and the separation of the regenerated caustic from the disulfides is accomplished in separate steps. Also, the separation is typically not complete, i.e. excessive disulfides remain in the caustic solution and regenerated caustic remains in the disulfides. These shortcomings limit the usefulness of the regenerated caustic for further extraction of sulfur compounds from the hydrocarbon stream in question in that the entrained disulfides (sulfur compounds) can be extracted back into the hydrocarbon stream defeating the purpose of treating the hydrocarbon stream with caustic, which is to remove sulfur compounds.

U.S. Pat. No. 2,921,021, Urban, et al, relates to the treatment of sour hydrocarbon distillate with an alkaline solution. The spent alkaline solution containing mercaptides is then mixed with air in a regenerator whereby the mercaptides are oxidized to disulfides. The regenerated caustic and disulfides are in the form of a finely dispersed mixture. The dispersion is passed through a coalescing system and then to a settling tank whereby the disulfide compounds are separated from the alkaline solution. While most of the disulfides are removed in the settling tank, in some cases the settling step may be followed by a naphtha wash to remove disulfides still retained in the alkaline solution.

U.S. Pat. No. 2,853,432, Gleim, et al., discloses the regeneration of used alkaline reagents by oxidizing same using a phthalocyanine catalyst. For example, mercaptides contained in a caustic solution were oxidized to disulfides, which were then withdrawn from the regeneration zone by skimming or by dissolving in a suitable solvent such as naphtha.

U.S. Pat. No. 3,574,093, Strong, relates to a multi-step process wherein the spent caustic generated by treating a low-boiling hydrocarbon stream for mercaptan removal is thereafter used in a second treating step wherein a higher boiling sour distillate is sweetened. In the sweetening step, the mercaptans in the sour distillate are oxidized to disulfides. The disulfides exit the treating stage in the hydrocarbon stream along with those mercaptides which had been previously extracted from the low boiling hydrocarbon stream. Thus, the higher boiling stream is sweetened and the partially spent alkaline stream is regenerated at the same time. The regenerated caustic is then introduced into a separation zone from which the disulfide phase is recovered from the caustic zone. The coalescence of the disulfide compound into a separate phase is stated to be extremely difficult without the use of coalescing agents. In addition, a high residence time is used in the separation zone to further facilitate this phase separation.

U.S. Pat. No. 4,362,614, Asdigian, also relates to a multi-step process for the extraction of mercaptans from hydrocarbon streams with an alkaline solution, followed by the regeneration of the mercaptide-containing alkaline solution resulting from such extraction by oxidation in the presence of a catalyst in an oxidation zone, followed by the separation of the disulfides and the alkaline solution by decantation within a phase separation zone. From this process, the alkaline solution is recycled. In addition to the requirement of a separate oxidation zone and a large settling zone, the use of additional coalescing means is said to be required.

U.S. Pat. No. 3,758,404, Clonts; U.S. Pat. No. 3,977,829, Clonts; and U.S. Pat. No. 3,992,156, Clonts, are directed to methods and apparatus for liquid-liquid mass transfer between immiscible liquids. A first liquid is introduced onto the upstream surface portion of a plurality of fibers extending generally along and secured within a conduit. A second liquid, immiscible with said first liquid, is flowed through the conduit cocurrently with the first liquid, thereby dragging a film of the first liquid along the fibers. The two liquids are collected at the downstream end of the conduit in a collection vessel or gravity separator. By this technique, a large surface area is generated between the two liquids and mass transfer between the two liquids is facilitated. As a result, a component of either of the liquids may be transferred either into or out of the liquid film as it moves along the fibers. The mass transfer may also occur as the result of a chemical reaction at the interface between the liquids, such as the removal of acidic constituents from a hydrocarbon by reaction with a base in an aqueous solution, or the transfer may be without a chemical reaction, such as by extraction from one liquid to another. The patents teach the introduction of an aqueous caustic solution onto the fibers and the flowing of gasoline containing acidic components cocurrently therewith. The acidic components of the gasoline react with and are absorbed by the caustic.

SUMMARY OF THE INVENTION

The present invention is directed to a new and improved method for regenerating alkaline streams of the nature described herein, whereby oxidation of mercaptides contained in a spent alkaline solution and separation (extraction) of the resulting disulfides from the alkaline solution takes place simultaneously within a single zone. The present invention results in an efficient compact regeneration system for regenerating spent alkaline solutions. Among its many advantages, other than those mentioned above, entrainment of the alkaline solution in the solvent/disulfide mixture is avoided since the method of contacting the caustic with the oxygen required for regeneration is not dispersive in nature. Yet another advantage of the present invention is that entrainment of disulfide in the regenerated caustic is avoided. Thus, separate washing steps to remove such entrained materials are unnecessary. For all of the above reasons, less equipment is required for the regeneration process of this invention than with methods known to the art, and the equipment which is utilized in the practice of the present invention is smaller in size and simpler to operate than that utilized in prior art processes. Therefore, equipment investment and costs of operation are substantially lower.

It is, therefore, an object of the present invention to provide an improved method of regenerating an alkaline stream such as an aqueous caustic solution containing mercaptan sulfur compounds, such as occurs in alkaline streams used in removing mercaptans from hydrocarbon distillates.

Another object of the present invention is to provide an improved process for treating an aqueous alkaline stream containing mercaptide compounds, wherein a stream containing an oxidation catalyst is introduced onto a plurality of fibers positioned longitudinally within a conduit, and a solvent having an oxygen-containing gas dissolved therein is flowed cocurrently through the conduit with the aqueous alkaline stream immiscible with the solvent, resulting in at least a portion of the mercaptide compounds being oxidized to disulfides and absorbed into the solvent.

Still other objects, features and advantages of the present invention will be apparent from the following description of the preferred embodiments, given for the purpose of disclosure, and taken in conjunction with the accompanying drawing.

DETAILED DESCRIPTION OF THE PREFERRED EMBODIMENT

Figure 1:
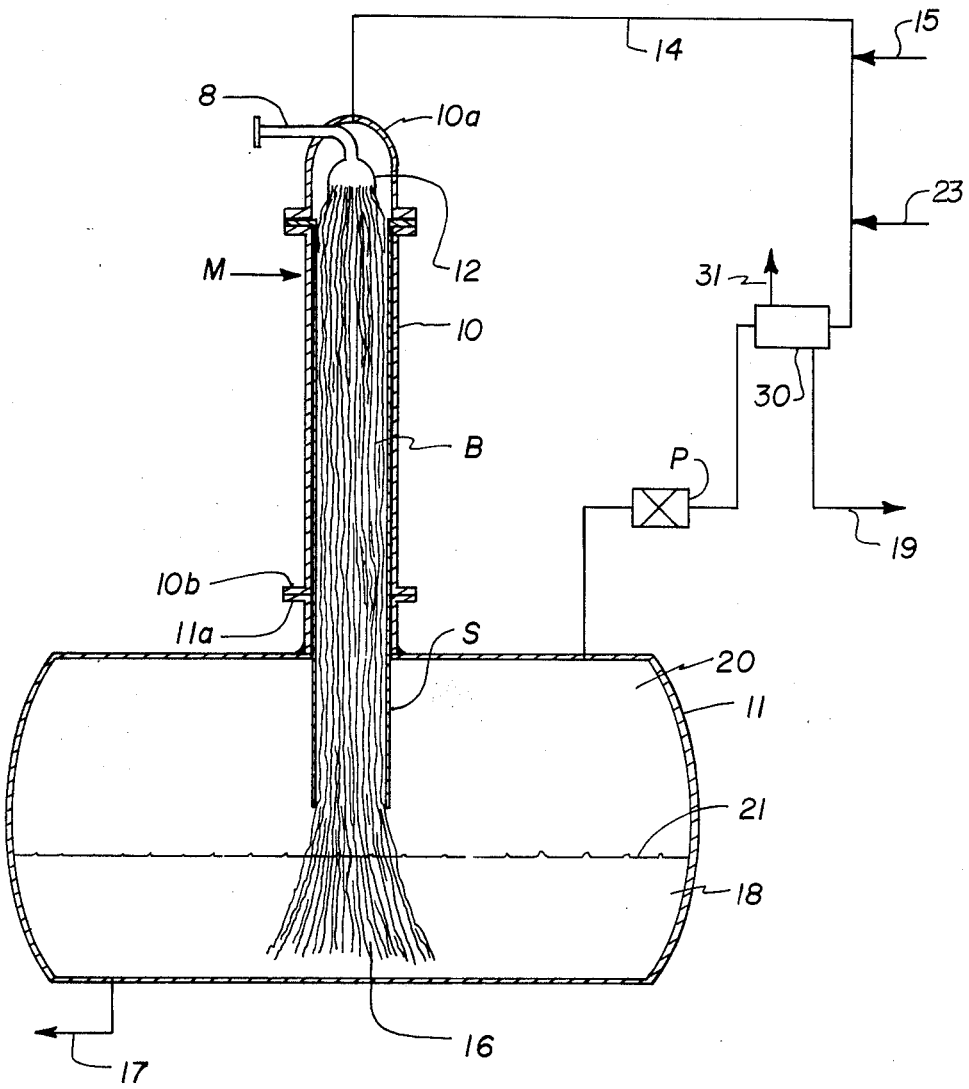
FIG. 1 is a schematic flow diagram of a process for regenerating an alkaline stream according to the present invention.

The process of the instant invention makes use of a mass transfer technique and apparatus as disclosed in U.S. Pat. Nos. 3,977,829 and 3,992,156, and reference may be made to such patents for a full description of the mass transfer apparatus.

In the preferred embodiment of the present invention and with reference to FIG. 1, a mass transfer apparatus M includes a bundle B of substantially continuous elongated fibers mounted in a shroud S and contained within a conduit 10. The conduit 10 has an outlet flange 10*b* that is adapted for connection or placement with a mating flange 11*a* of collection vessel 11. A fluid distribution means 12 is mounted within an upper position of conduit inlet assembly 10*a* for distributing the mercaptide-containing aqueous alkaline solution to be regenerated from the spent alkaline feed line 8 onto the fibers within the bundle B. A second solution line 14 is attached to the conduit inlet assembly 10*a* for delivering the oxygen-containing solvent into the conduit inlet. The conduit outlet 10*b* is attached to mounting flange 11*a* of the collection vessel 11. Shroud S contains fiber bundle B which extends partly within the confines of the collection vessel 11. Other mechanical details of the mass transfer apparatus M are not necessary to an understanding of the invention and reference may be made to the aforementioned patents for further additional mechanical details. The positioning of the downstream end of the bundle B within the collection vessel 11 is such that it is within the regenerated alkaline solution which is collected as a lower layer in the collection vessel 11.

Collection vessel 11 contains a lower layer 18 of regenerated alkaline solution and an upper layer 20 of hydrocarbon solvent containing disulfides. Collection vessel 11 is preferably maintained at conditions which avoid the separation of gases from the liquids therein. The formation of gases within collection vessel is avoided so as to prevent entrainment of the hydrocarbon solvent containing disulfides in the regenerated alkaline stream.

The fibers that comprise the bundle B are selected to meet two criteria. The fiber material must be preferentially wetted by the aqueous alkaline solution introduced by feed line 8 and the fibers must be of a material that will not contaminate the process or be destroyed by it, such as by corrosion. Accordingly, inasmuch as the present invention deals with aqueous alkaline solutions containing sulfur compounds, metallic fibers and, in particular, stainless steel or special corrosion resistant alloy fibers, are preferably employed.

The spent alkaline streams which may be regenerated according to the present invention, include, for example, spent aqueous potassium hydroxide solutions and spent aqueous sodium hydroxide solutions, i.e. caustic. Such alkaline solutions are widely used for treatment of a variety of mercaptan containing hydrocarbon streams, including liquid petroleum gas (LPG), butanes, butenes, gasoline streams and naphthas and the like. These spent alkaline solutions resulting from the treatment of the aforementioned hydrocarbon streams can typically contain a number of different mercaptan sulfur compounds, including, for example, such mercaptans as methyl mercaptan, ethyl mercaptan, n-propyl mercaptan, iso-propyl mercaptan, n-butyl mercaptan, and thiophenol. Alkali metal sulfides can also be present in such spent alkaline solutions due to the presence of hydrogen sulfide in the hydrocarbon streams which were previously treated with the alkaline solution. The presence of such sulfides does not adversely affect the efficiency of the present invention.

In order to regenerate mercaptide-containing alkaline streams according to the present invention, the spent alkaline stream containing an oxidation catalyst is flowed through line 8 into the inlet 10*a* and to the fluid distribution means 12 and onto the upstream end of the fiber bundle 6 as illustrated in FIG. 1. Simultaneously, a suitable hydrocarbon solvent containing a dissolved oxygen-containing gas such as air, is flowed through line 14, into the conduit inlet 10*a*, and then cocurrently with and in intimate contact with the alkaline stream, passing over the fibers of the fiber bundle B contained within conduit 10, and then into the collection vessel 11. During the time the two immiscible fluids are in contact within conduit 10, the mercaptides contained in the spent alkaline solution are oxidized to disulfides and the disulfides are extracted into the hydrocarbon solvent and are thus removed from the alkaline solution.

As previously mentioned, the fiber material must be preferentially wetted by the aqueous alkaline solution introduced by feed line 8. If, however, the volumetric flow ratio of the hydrocarbon solvent to alkaline solution is less than about 1:1, phase inversion may occur resulting in the fiber material being preferentially wetted by the hydrocarbon solvent. It is preferred, therefore, that the volumetric flow ratio of the hydrocarbon solvent to alkaline solution be at leeast about 1:1, more preferably from about 2:1 to about 20:1, still more preferably about 3:1 to about 7:1, most preferably about 5:1.

The oxidation reaction will occur at temperatures of from ambient to about 150° F. The preferred operating temperature is from about 100° F. to about 130° F.

The oxidation reaction is very fast, however, sufficient time must be allowed for the oxygen to be transferred to the alkaline stream and for the resulting disulfides to be transferred back into the hydrocarbon stream. Because of the efficiency of the mass transfer apparatus, residence time in the fiber bundle may be rather short, from about thirty second to about three minutes. Preferred residence times are from about one to about two minutes.

The oxidation catalyst contained in the alkaline stream may be any suitable oxidation catalyst known to those skilled in the art and preferably comprises a metal phthalocyanine dissolved or suspended in the alkaline stream entering the system through the line 8. Metal phthalocyanines that may be employed include cobalt phthalocyanine and vanadium phthalocyanine or sulfonated or carboxylated derivatives thereof. A preferred catalyst comprises cobalt phthalocyanine disulfonate. The catalyst concentration will vary depending in part on the level of mercaptides in the alkaline stream, as will be understood by those skilled in the art. Typically, the amount of cobalt phthalocyanine disulfonate may range from about 10 to about 1,000 ppm by weight of the alkaline solution.

The oxygen required for the oxidation of the mercaptides is introduced into the system through line 15 by dissolving oxygen or an oxygen-containing gas, such as air, in the hydrocarbon solvents stream 14. In the fiber bundle B, the oxygen is transferred from the hydrocarbon stream into the alkaline solution. Oxygen thus is available for chemical reaction with the mercaptides in the presence of the oxidation catalyst contained in the spent alkaline stream as the respective fluids move through the mass transfer apparatus M. The amount of oxygen provided is at least equal to the stoichiometric amount and generally is provided in excess of the stoichiometric amount. The pressure in the system is maintained at a level such that the desired amount of oxygen can be dissolved into the hydrocarbon stream without exceeding the solubility limits for oxygen or the oxygen-containing gas in the hydrocarbon.

The higher the mercaptide concentration of the spent caustic to be regenerated, the more oxygen or oxygen containing gas must be dissolved in the hydrocarbon and higher system back pressure must be maintained in order to keep such amounts of oxygen containing gas in solution. Typical system back pressures range from 10 psig to 100 psig with system back pressures of from about 25 psig to about 75 psig typically being sufficient for most normal mercaptide loadings.

Any suitable organic solvent which is immiscible with the aqueous alkaline stream and does not otherwise adversely affect the overall process may be utilized. For example, many of the hydrocarbon streams described above as being treatable for mercaptan removal with alkaline streams may be employed as the solvent. Use of the hydrocarbon which has been treated by the alkaline stream such as aromatics, gasoline, hexane, kerosene, naphtha, or mixtures of any such organic solvents will avoid the possibility of contamination of the hydrocarbon stream by solvent which is entrained in the recirculating alkaline stream.

The downstream end of shroud S containing the fiber bundle B extends into the collection vessel 11 sufficiently so as to allow the end 16 of the fiber bundle to contact the regenerated alkaline stream layer 18. Thus, as the alkaline and solvent streams flow from the conduit 10 into the collection vessel 11, the regenerated alkaline stream, being immiscible with the solvent, separates and collects as a bottom layer 18 and the hydrocarbon solvent, now containing disulfides, accumulates as an upper layer 20 in the collection vessel 11. The interface 21 between the solvent and regenerated alkaline solution may vary, but it is preferred that the interface remain above the lower or downstream end of the fiber bundle B as illustrated in FIG. 1. As a result of the simultaneous oxidation of mercaptides to disulfides and extraction of the disulfides into the solvent within the fiber bundle B, a regenerated alkaline stream 17 of reduced mercaptide content is produced.

The solvent and the regenerated alkaline streams are withdrawn separately from the collection vessel 11. The regenerated alkaline stream 17 is recycled for further use, for example, in further contacting of mercaptan-containing hydrocarbon streams. In a typical regeneration system, it may be necessary from time to time to purge some of the regenerated alkaline solution from the recirculation loop and replace it with fresh alkaline solution. This is generally done as needed to control the buildup of sulfides or thiosulfates which may be present in the system due to the presence of hydrogen sulfide in the hydrocarbon stream being treated with the alkaline solution prior to the regeneration step. The addition of fresh alkaline solution may also be necessitated due to the dilution effect resulting from the oxidation of the mercaptides wherein water is a co-product of the oxidation reaction.

The hydrocarbon solvent containing disulfide compounds may be processed further to recover the disulfide component therefrom, may be discarded in an environmentally safe manner, or may be recycled to the inlet line 14 for further use in the process of the present invention. In the latter event, it may be necessary to pass the solvent solution through a degasing zone 30 wherein the pressure is reduced by a suitable pressure relief valve P to enable the dissolved gases (generally rich in nitrogen if air is used as the oxygen source since the major portion of the oxygen is consumed in oxidizing mercaptides within the conduit 10) to come out of solution and be separated therefrom through vent 31. This, of course, would not be necessary if oxygen itself were used for the oxidation. Also, since the solvent loses its effectiveness as its level of disulfides increases, it may be desirable to remove some of the disulfide-containing solvents such as through line 19 and to add fresh, lean solvent such as through line 23 from time to time or in a continuous mode, in order to maintain the proper efficiency of extraction of disulfides.

It has been found that the present method of regenerating alkaline streams is quite superior to conventional processes employing separate zones to effect the oxidation and separation steps inherent in the overall regeneration process. Moreover, the use of a suitable fiber bundle contacting device in the present invention provides for a compact process and results in reduced capital costs.

It will be understood by those skilled in the art that the efficiency of the overall regeneration process of the present invention will depend upon a number of parameters, including the rates of mass transfer of oxygen into the alkaline stream to provide the oxygen for the catalytic oxidation of the mercaptides to disulfides and the extraction of the resulting disulfide from the alkaline stream into the solvent. Such parameters as the surface area of the fiber bundle B, the rate of flow of streams entering the lines 8 and 14, the amounts of dissolved oxygen in either of the reactant streams, the amount of catalyst contained in the alkaline stream, residence time of the respective materials within the mass transfer apparatus M, and temperature and pressure conditions may be varied depending on the chemical composition of sulfur compounds contained in the alkaline stream to be regenerated, the type of hydrocarbon solvent used, and other factors as will be appreciated by those skilled in the art.

The following are examples illustrating the process of the present invention and are not intended to limit the scope thereof.

EXAMPLE 1

To demonstrate the effectiveness of carrying out the process of the present invention, a bench scale mass transfer apparatus was constructed embracing the principles illustrated in U.S. Pat. No. 3,977,829. The apparatus consisted of a vertically oriented $16' \times \frac{1}{2}''$ I.D. beaded glass column (conduit) connected to a horizontally oriented $3' \times 3''$ I.D. beaded glass pipe (collection vessel) with one-half inch beaded glass nipples suitably located for removal of the lower regenerated caustic layer and the upper solvent-disulfide mixture. A fiber bundle consisting of stainless steel fibers had been inserted within the beaded glass column (conduit) such that the downstream end of the fibers would extend into the regenerated caustic layer in the lower portion of the collection vessel.

As representative sample of the mercaptide-containing alkaline solution to be subjected to the regeneration process of the present invention, a 15% by weight aqueous solution of sodium hydroxide to which had been added methyl mercaptan in an amount such that the mercaptide concentration was 640, expressed in ppm as sulfur was introduced to the top of the fiber bundle at a flow rate of 164 ml/min. The caustic solution also contained 100 ppm of cobalt phthalocyanine disulfonate as an oxidation catalyst. Also introduced into the top of the beaded glass column was a kerosene solvent stream into which air had been injected and dissolved. The kerosene flow rate was 602 ml/min. and the air injection rate was 0.0096 SCFM. The caustic solution and the kerosene solution flowed cocurrently through the fiber bundle. The pressure in the system was maintained at 52 psig and the operating temperature was approximately 133° F. In the collection vessel, the regenerated caustic collected as a lower layer and the kerosene collected as an upper layer, both of which were continuously removed, sampled and analyzed for mercaptan sulfur content and disulfide content.

The regenerated caustic was found to contain 6 ppm mercaptans as sulfur and 2 ppm disulfide as sulfur. The kerosene solution obtained from the collection vessel was found to have 5,240 ppm disulfide as sulfur. This data indicates that the regeneration of the caustic solution was very effective and that the disulfide removal in the kerosene solvent was very effective.

EXAMPLE 2

Utilizing the bench scale unit and procedures described in Example 1, mercaptide-containing caustic solution was prepared from 15% by weight solution hydroxide to which ethyl mercaptan was added in an amount such that the mercaptide concentration was 428, expressed as ppm sulfur. The caustic solution also contained 100 ppm of cobalt phthalocyanine disulfonate as an oxidation catalyst. This solution was introduced into the top of the fiber bundle at a flow rate of 170 ml/min. Also introduced into the top of the beaded glass column was a hexane solvent stream into which air had been injected and dissolved. The hexane flow rate was 515 ml/min. and the air injection rate was 0.007 SCFM. The pressure in the system was maintained at 50 psig and the operating temperature was approximately 106° F. The regenerated caustic was analyzed and was found to contain nil mercaptan sulfur and only 1 ppm disulfide as sulfur. The effluent hexane was analyzed and found to contain 1,700 ppm as sulfur, disulfide. Again, the regeneration of the caustic was very effective both in terms of mercaptide sulfur and disulfide removal.

EXAMPLE 3

Utilizing the apparatus and procedures described in Example 1, a synthesized spent caustic containing ethyl mercaptide was regenerated by the process of the present invention and the solvent employed was kerosene. Fifteen percent by weight sodium hydroxide was used to prepare the spent caustic solution to be regenerated, the ethyl mercaptide concentration was 1,230 ppm as sulfur, and the caustic solution contained 100 ppm of cobalt phthalocyanine disulfonate. This spent caustic was introduced into the fiber bundle at a flow rate of 167 ml/min. The kerosene flow rate was 600 ml/min. and the air injection rate 0.0068 SCFM. The pressure in the system was maintained at 50 psig and the operating temperature was approximately 106° F. The regenerated caustic was found to contain nil mercaptan sulfur and only 6 ppm disulfide as sulfur. The effluent kerosene was found to contain 5,240 ppm disulfide as sulfur. This demonstrates very effective regeneration of the caustic solution.

EXAMPLE 4

Utilizing the apparatus and procedures described in Example 1, a synthesized spent caustic containing sodium thiophenate (an aromatic mercaptide) was regenerated by the process of the present invention and the solvent employed was hexane. Fifteen percent by weight sodium hydroxide was used to prepare the spent caustic solution by adding thiophenol in an amount such that the thiophenate concentration was 1,160 ppm as sulfur, and cobalt phthalocyanine disulfonate was present at a concentration of 100 ppm. The spent caustic was introduced into the fiber bundle at a flow rate of 56 ml/min. The hexane flow rate was 305 ml/min. and the air injection rate was 0.0062 SCFM. The pressure in the system was maintained at 50 psig and the operating temperature was approximately 107° F. The regenerated caustic was found to contain 190 ppm thiophenate as sulfur indicating substantial regeneration of the caustic.

EXAMPLE 5

Utilizing the apparatus and procedures described in Example 1, a sample of a spent caustic feed to a conventional caustic regeneration unit within a refinery was subjected to the process of the present invention. The spent caustic analyzed as follows:

| | |
|---|---|
| Density | 1.23 g/ml |
| Percent NaOH | 21.9% |
| Sulfide | 880 ppm |
| Mercaptides | 2,260 ppm as S |
| Cobalt Phthalocyanine Disulfonate | 100 ppm |

The approximate homolog distribution of the mercaptides was as follows:

| Homolog | Percentage of Total (as Sulfur) |
|---|---|
| Methyl | 24 |
| Ethyl | 38 |
| Isopropyl | 11 |
| N—Propyl | 11 |
| Sec-Butyl | 4 |
| Iso & Tert-Butyl | 3 |
| $C_5$+ and Thiophenol | 9 |

The spent caustic was introduced into the top of the fiber bundle at a flow rate of 43 ml/min. Kerosene was introduced at a flow rate of 218 ml/min. and the air injection rate was 0.0090 SCFM. The pressure in the system was maintained at 50 psig and the operating temperature was approximately 88° F. The regenerated caustic was found to contain nil mercaptide indicating that the regeneration of the caustic was very effective.

The present invention, therefore, is well adapted to carry out the objects and attain the end and advantages mentioned, as well as those inherent herein. While presently preferred embodiments of the invention have been given for the purpose of disclosure, numerous changes in the details of construction, arrangements of parts and operation of the process can be made which will readily suggest themselves to those skilled in the art and which are encompassed within the spirit of the invention and the scope of the appended claims.

What is claimed is:

1. A process for regenerating an aqueous stream of alkali metal hydroxide containing mercaptide compounds by the simultaneous oxidation of mercaptides to disulfides and extraction of the disulfides formed from the aqueous stream, comprising:

introducing an aqueous stream of alkali metal hydroxide containing mercaptide compounds and an oxidation catalyst onto an upstream end of a plurality of fibers positioned longitudinally within a conduit, a downstream end of the fibers extending out of the conduit making contact with a regenerated alkali metal hydroxide liquid layer in a collection vessel, wherein the fibers must be preferentially wetted by the aqueous stream;

flowing a liquid stream of hydrocarbon solvent having at least the stoichiometric amount of oxygen from an oxygen-containing gas dissolved therein cocurrently through the conduit, with and in contact with the stream of alkali metal hydroxide, at a flow rate, temperature and pressure whereby at least a portion of the mercaptide compounds in the alkaline stream are oxidized to disulfides;

simultaneously with oxidation of the mercaptide compounds in the conduit extracting at least a portion of the disulfides formed into the hydrocarbon solvent from the stream of alkali metal hydroxide;

receiving said hydrocarbon solvent and said alkali metal hydroxide streams in a collection vessel wherein the alkali metal hydroxide stream of reduced mercaptide content forms a layer in the lower portion of said collection vessel and the hydrocarbon solvent containing the extraction disulfides forms a layer in the upper portion of said collection vessel;

withdrawing said hydrocarbon solvent containing the extracted disulfide from the upper portion of said collection vessel; and withdrawing the alkali metal hydroxide of reduced mercaptide content from the lower portion of said collection vessel for reuse.

2. The process of claim 1, wherein the hydrocarbon solvent is withdrawn from the collection vessel and introduced into a de-gasing zone wherein the dissolved residual gases are allowed to separate therefrom and the hydrocarbon solvent of reduced residual gases is thereafter recycled to the process for further use.

3. The process of claim 1, wherein the alkali metal hydroxide is sodium hydroxide.

4. The process of claim 1, wherein the hydrocarbon solvent boils in the gasoline range or above.

5. The process of claim 1, wherein the oxidation catalyst comprises a metal phthalocyanine or a derivative thereof.

6. The process of claim 1, wherein the oxygen-containing gas is air.

7. The process of claim 1, wherein the hydrocarbon solvent is selected from the group consisting of gasoline, naphtha, kerosene and hexane, and mixtures thereof.

8. The process of claim 1, wherein said temperature is from about 100° F. to about 130° F.

9. The process of claim 1, wherein said pressure is from about 25 psig to about 75 psig.

10. The process of claim 1, wherein the flow rates of said aqueous stream of alkali metal hydroxide and said stream of hydrocarbon solvent are such that a contact time of from about one minute to about two minutes results.

11. The process of claim 5, wherein the oxidation catalyst comprises cobalt phthalocyanine disulfonate.

12. A process for regenerating an aqueous stream of alkali metal hydroxide containing mercaptide compounds by the simultaneous oxidation of mercaptide to disulfides and extraction of the disulfides formed from the aqueous stream, comprising:

introducing an aqueous stream of alkali metal hydroxide containing mercaptide compounds and an oxidation catalyst onto an upstream end of a plurality of fibers positioned longitudinally within a conduit, a downstream end of the fibers extending out of the conduit making contact with a regenerated alkali metal hydroxide liquid layer in a collection vessel, wherein the fibers must be preferentially wetted by the aqueous stream;

contacting the stream of alkali metal hydroxide, in cocurrent flow through the conduit with a liquid stream of hydrocarbon solvent having at least the stoichiometric amount of oxygen from an oxygen containing gas dissolved therein at a volumetric flow ratio of said hydrocarbon solvent to said alkali metal hydroxide of at least about 1:1, and at a temperature and pressure whereby at least a portion of the mercaptide compounds in the alkaline stream are oxidized to disulfides;

simultaneously, with oxidation of the mercaptide compounds in the conduit, extracting at least a portion of the disulfides formed into the hydrocarbon solvent from the stream of alkali metal hydroxide;

receiving said hydrocarbon solvent and said alkali metal hydroxide streams in a collection vessel wherein the alkali metal hydroxide stream of reduced mercaptide content forms a layer in the lower portion of said collection vessel and the hydrocarbon solvent containing the extracted disulfides forms a layer in the upper portion of said collection vessel;

withdrawing said hydrocarbon solvent containing the extracted disulfide from the upper portion of said collection vessel; and withdrawing the alkali metal hydroxide of reduced mercaptide content from the lower portion of said collection vessel for resuse.

13. The process of claim 12, wherein said volumetric flow ratio is from about 2:1 to about 20:1.

14. The process of claim 13, wherein said volumetric flow ratio is from about 3:1 to about 7:1.

15. The process of claim 14, wherein said volumetric flow ratio is about 5:1.

* * * * *

UNITED STATES PATENT AND TRADEMARK OFFICE

CERTIFICATE OF CORRECTION

PATENT NO. : 4,666,689

DATED : May 19, 1987

INVENTOR(S) : Ralph E. Maple; George L. Redd; Donald W. Meurer

It is certified that error appears in the above-identified patent and that said Letters Patent is hereby corrected as shown below:

In column 2, line 12 after "the" delete "cleaness" and insert therefor -- cleanness --.

In column 6, line 18 after "thirty" delete "second" and insert therefor -- seconds --.

In column 10, line 35 after "nil" delete "mercaptide" and insert therefor -- mercaptides --.

Signed and Sealed this

Eighth Day of September, 1987

*Attest:*

*Attesting Officer*

DONALD J. QUIGG

*Commissioner of Patents and Trademarks*